United States Patent [19]

Yamamoto et al.

[11] Patent Number: 4,956,904

[45] Date of Patent: Sep. 18, 1990

[54] DEVICE FOR JOINING PIPING MATERIALS

[75] Inventors: Hidetoshi Yamamoto; Taiji Gotoh, both of Kuwana; Yoshinori Katoh, Mie, all of Japan

[73] Assignee: Mie Horo Co., Ltd., Mie, Japan

[21] Appl. No.: 397,461

[22] PCT Filed: Dec. 5, 1988

[86] PCT No.: PCT/JP88/01226

§ 371 Date: Aug. 15, 1989

§ 102(e) Date: Aug. 15, 1989

[87] PCT Pub. No.: WO89/06168

PCT Pub. Date: Jul. 13, 1989

[30] Foreign Application Priority Data

Dec. 29, 1987 [JP] Japan ..... 62-199657

[51] Int. Cl.[5] ..... F16L 35/00

[52] U.S. Cl. ..... 29/237

[58] Field of Search ..... 29/237, 252, 280, 432, 29/525, 283.5; 285/39, 382.1–382.7, 382

[56] References Cited

U.S. PATENT DOCUMENTS 4,257,135 3/1981 Moebius ..... 29/237
4,328,608 5/1982 Gibson ..... 29/237
4,418,458 12/1983 Hunter ..... 29/237
4,483,056 11/1984 Schwalm et al. ..... 29/237
4,696,085 9/1987 Sauder ..... 29/237

FOREIGN PATENT DOCUMENTS 57-109536 7/1982 Japan .
57-142729 9/1982 Japan .
61-63325 4/1986 Japan .

*Primary Examiner*—Robert C. Watson
*Attorney, Agent, or Firm*—Frishauf, Holtz, Goodman & Woodward

[57] ABSTRACT

This invention relates to a device for joining piping materials such as a piping material and a pipe coupling.

The piping materials are joined together by inserting one end of a piping material into a pipe coupling having a tapered and expanded diameter portion, and by causing the joint of these piping materials where they are overlapped with each other to be plastically deformed with a pair of processing dies which are movable in a direction parallel to the axis of the piping materials.

The half-die members can be kept in parallel to each other when they are moved closer to each other, thereby to provide uniform and rigid junction therebetween.

4 Claims, 4 Drawing Sheets

DEVICE FOR JOINING PIPING MATERIALS

TECHNICAL FIELD

This invention relates to a device for joining piping materials comprising a pair of processing dies which are movable in a direction parallel to the axis of the piping materials, by which the two piping materials, such as a piping material and a pipe coupling, are joined together by inserting one end of a piping material into a pipe coupling having a tapered and expanded diameter portion, and by causing the joint of these piping materials where they are overlapped with each other to be plastically deformed with the above processing dies.

BACKGROUND ART

In the prior art, joining of piping materials is usually achieved by means of press rolls rotatively driven to caulk the joint of the piping materials where they are overlapped with each other. However, the joining of piping materials by use of such rotatively driven press rolls unfavorably requires a complicated structure, leading to an expensive and large-sized device to make the handling of the piping materials in the site of piping operation quite troublesome.

Thus, the present applicant previously proposed a device for joining piping materials without using press rolls in the Japanese Provisional Patent Publication (KOKAI) No. 109536/1982, which involves YOSEZUME (a plural number of dies movable in the radial direction) as the caulking means which can approach the piping materials in the orthogonal direction to the axis of the piping materials, but this device also suffers a problem of complicated cam mechanism for interlocking the YOSEZUME.

Furthermore, the present applicant proposed a device for joining piping materials in the Japanese Provisional Patent Publication (KOKAI) No. 142729/1982, in which a pair of dies are allowed to approach relative to each other in a direction parallel to the axis of the piping materials by use of cams which are movable in the orthogonal direction to the axis of the piping materials to achieve joining of the piping materials. Nevertheless, there remains a problem that the dies fail to keep their parallel face-to-face relationship because of the structure in which the dies are only pushed at their back portions by the cams to receive greater resistance from the piping materials at their portions facing to the piping materials to break the parallel relationship therebetween, whereby said portions are slightly opened or lifted up from the surface of the piping material as compared with the back portions thereof, so that the joining of a piping material and a pipe coupling cannot be achieved properly.

DISCLOSURE OF THE INVENTION

This invention has been accomplished for the purpose of overcoming such problems inherent in the prior art and providing a device for joining piping materials which can achieve joining of piping materials, such as a piping material and a pipe coupling, properly, wherein dies disposed in the device can keep their parallel posture using a simple structure.

The device for joining piping materials according to this invention comprises a first processing die 24 in which a pair of half-die members 28 each having inclined cam faces 28*a* formed thereon are combined through connecting means, the above half-die members being mutually approachable in the direction parallel to the axis of the piping materials to be joined by use of a means for moving them closer or farther relative to each other; a second processing die 26 having a similar constitution to that of the first processing die 24, composed of a pair of half-die members 28, to be disposed symmetrically relative to the axis of the first processing die 24 and the piping materials; a first and a second box-shaped cam housing 2 and 12 for receiving the above two processing dies 24 and 26, respectively, and is disposed to oppose each other so as to move said pair of die members closer to each other, wherein the above first and second box-shaped cam housings 2 and 12 having cam faces 10*a* and 12*a*, respectively, which push the inclined cam faces 28*a* formed on the above pair of half-die members 28, so as to move the above pair of half-die members 28 closer to each other; and guide plates 36 being disposed in at least one of the above two box-shaped cam housings to keep the above pair of half-die members 28 to perform a parallel movement to be closer or farther relative to each other.

Figure 1:
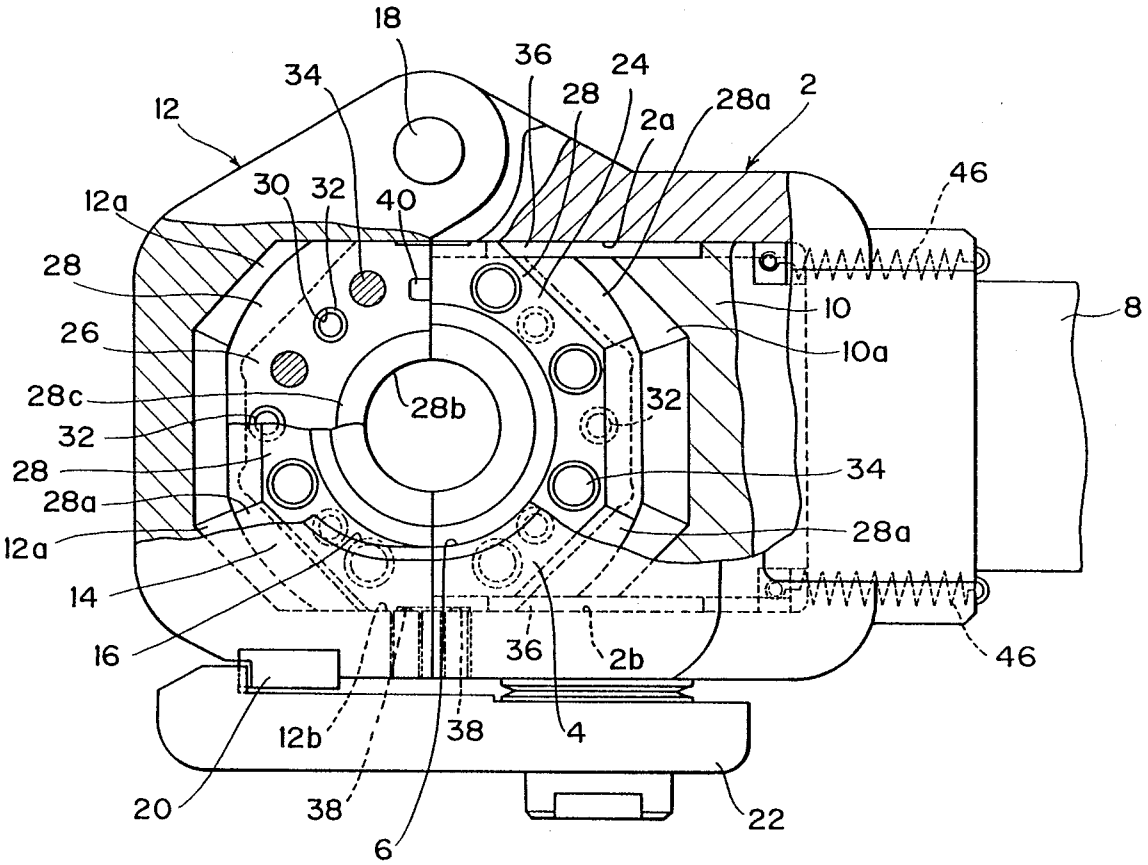
FIG. 1 shows an embodiment of a device for joining piping materials according to this invention in partially cutaway side view.
Figure 2:
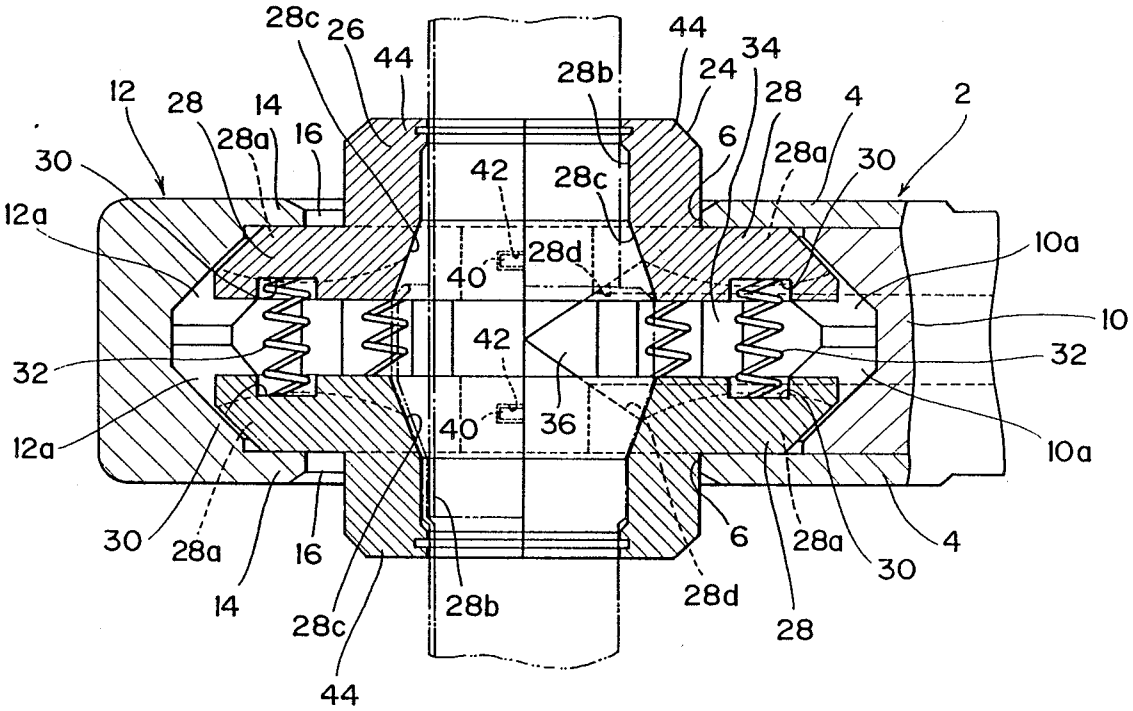
FIG. 2 shows a plan view of the present joining device in cross-section, illustrating a state before joining of the piping materials.

2: First box-shaped cam housing
10: Cam body
10*a*: Inclined cam face
12: Second box-shaped cam housing
12*a*: Inclined cam housing
24: First processing die
26: Second processing die
28: Half-die member
28*a*: Inclined cam face
36: Guide plate

BEST MODE FOR CARRYING OUT THE INVENTION

Next, the device for joining piping materials of this invention will be described in more detail by way of the embodiment shown in the drawings.

Figure 4:
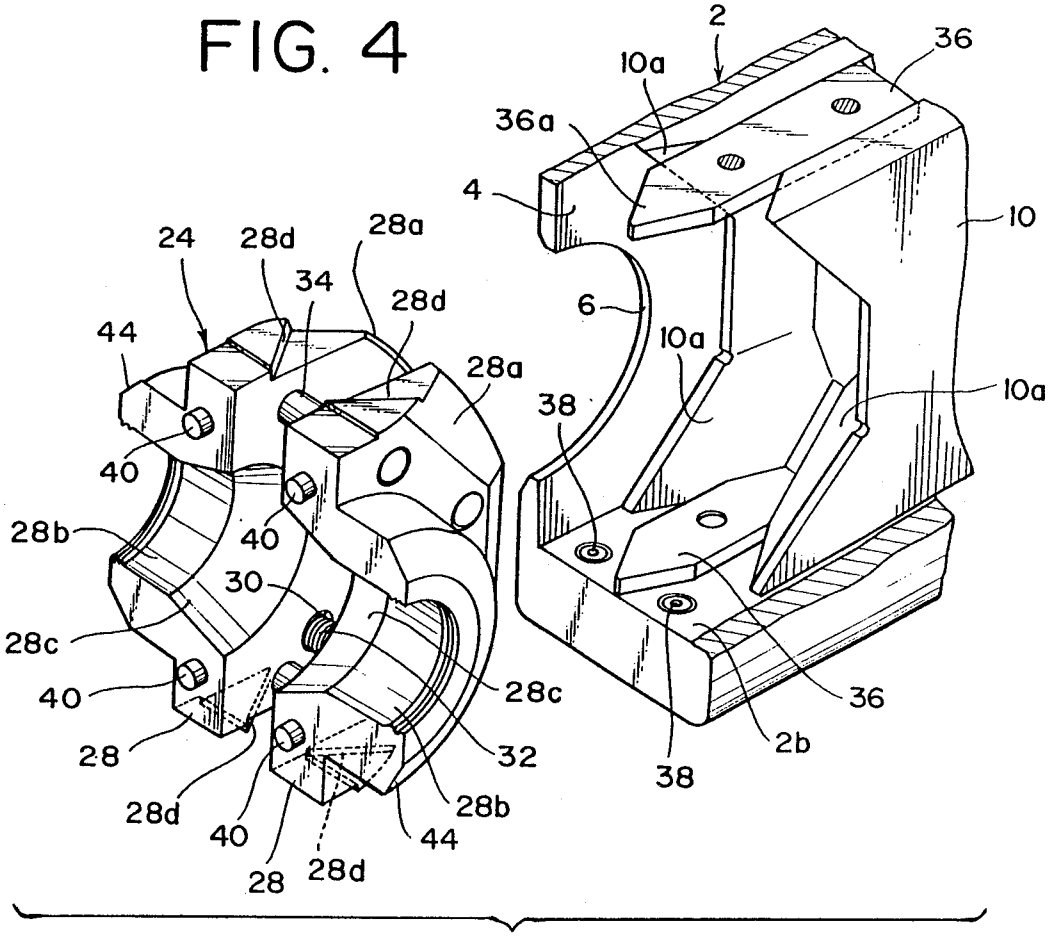
FIG. 4 shows a partially cutaway perspective view of the present joining device, illustrating the relationships between the first box-shaped cam housing and the processing die.

In the drawings, a first box-shaped cam housing 2 has two side wall plates 4 each having a semicircular notch (opening) 6 for inserting piping materials to be supported therethrough formed in the middle of the front ends thereof. In the first box-shaped cam housing 2, there is disposed a cam body 10, having inclined cam faces 10*a* formed on the internal surfaces thereof, to be pushed forward by a hydraulic cylinder 8 provided at its rear end, the cam faces 10*a* each opening outward in the forward direction to the front end with an angle of around 45 degree, as shown in FIG. 4.

The numeral 12 shows a second box-shaped cam housing, which has, similarly to the above first box-shaped cam housing, two side wall plates 14 each having a semicircular notch 16 for inserting the piping materials to be supported therethrough formed in the middle of the front ends thereof. The second box-shaped cam housing 12 has inclined cam faces 12*a* formed inside thereof, corresponding to the cam faces 10*a* of the cam body 10 mentioned above.

The second box-shaped cam housing 12 is pivoted to the first box-shaped cam housing 2 by means of a hinge pin 18, such that they may be opened or closed, and the two box-shaped cam housings 2 and 12 are designed to be clamped in a closed posture by allowing a clutch plate 20 disposed to the bottom of the second box-shaped cam housing 12 to be interlocked by a clutch hook 22 pivoted to the outer bottom face of the first box-shaped cam housing 2.

The numerals 24 and 26 show a pair of processing dies (first and second), respectively, to be received in the above first and second box-shaped cam housings 2 and 12, and each having a pair of half-die members 28.

Each of the half-die members 28 has an inclined cam face 28*a* defined at its outer back side, with which the first box-shaped cam housing 2 is fitted, corresponding to the cam face 10*a* of the cam body 10, a supporting surface 28*b* formed to have a semicircular cross-section for supporting the piping materials to be joined at its forward end, and a tapered internal peripheral surface 28*c* contiguous to the supporting surface 28*b*. Each of the die-members 28 further has guide surfaces 28*d* formed on the upper and lower ends in such a manner that the guide surfaces 28*d* in pair may form a V-shape to open rearwards when the half-die members 28 are combined. The half-die members 28 have spring retention holes 30 on the opposing surfaces in each of which there is interposed a compression spring 32 which can fully be pressed back therein upon application of pressure, so that they can be moved closer or farther relative to each other with the aid of guide pins 34.

Accordingly, the first and second processing dies 24 and 26 are fitted in the interior portion of the first and second box-shaped cam housings 2 and 12, respectively, and combined to form a complete set of processing dies.

Tapered guide plates 36 are disposed to the upper interior surface 2*a* and the bottom interior surface 2*b* of the first box-shaped cam housing 2. These guide plates 36 guide in combination with the guide surfaces 28*d* formed on the upper and lower end surfaces of each processing die, the half-die members 28 to move closer (or farther) keeping their parallel relationship along the axis of the piping materials.

Namely, upon actuation of the hydraulic cylinder 8, the first processing die 24 is advanced toward the second processing die 26 being pushed by the cam body 10, and also the inclined cam faces 28*a* of the half-die members 28 are pushed diagonally inward by the cam body 10.

Thus, the half-die members 28 approach relative to each other resisting against the force of the compression springs 32, wherein this approaching motion of the half-die members 28 is guided by bringing the tip ends 36*a* of the guide plates 36 into contact with the guide surfaces 28*d*, to approach along the axis of the piping materials keeping their parallel relationship consistently.

Ball plungers 38 are disposed on the fore portions on the bottom 2*b* of the first box-shaped cam housing 2 and the bottom 12*b* of the second box-shaped cam housing 12, respectively. These ball plungers 38 are designed to facilitate fitting of the processing dies 24 and 26 through one-touch operation to the box-shaped cam housings 2 and 12, so that they may be separated from each other as the two box-shaped cam housings 2 and 12 are separated from each other, without slipping off therefrom.

The half-die members 28 of the first processing die 24 have pins 40 protruding from the front side end thereof, and by fitting these pins 40 into recesses 42 formed on the front side end of the second processing die 26, the two processing dies 24 and 26 can be engaged to be movable integrally along the direction parallel to the axis of the piping materials.

Incidentally, the numeral 44 shows a semicylindrical holder of the piping materials formed to protrude from each half-die member 28, and the numeral 46 shows a return spring for resetting the cam body 10 when the hydraulic cylinder 8 is of a single-acting type.

Work

When a pipe coupling 48 and a piping material 50 are joined by means of the joining device having such constitution, the two box-shaped cam housings 2 and 12 are first opened to separate the two processing dies 24 and 26 from each other.

Next, the piping material 50 and the pipe coupling 48 are set on the supporting surfaces 28*b* having a semicircular cross-section, forming in the half-die members 28 of the processing die 24, and the tapered joining portions of the pipe coupling 48 are allowed to be supported by the tapered internal peripheral surfaces 28*c* of the half-die members 28.

Thereafter, the first box-shaped cam housings 2 and the second box-shaped cam housing 12 are clamped together, whereby the two processing dies 24 and 26 are fitted together to hold the joining portion of the pipe coupling 48 on the tapered internal peripheral surfaces 28*c*.

Next, the hydraulic cylinder 8 is actuated to push the cam body 10 fitted in the first box-shaped cam housing 2 in the orthogonal direction to the axis of the piping materials, so that the processing dies 24 may be moved toward the second box shaped cam housing 12 with the aid of the inclined cam surface 28*a* formed on the outer back side of each half-die member 28, and the processing die 26 is moved likewise. Simultaneously, the half-die members 28 in each processing die 24 or 26 are pushed inwardly by virtue of the inclined cam faces 10*a* of the cam body 10 and 12*a* of the second box-shaped cam housing 12, resisting against the force of the compression springs 32 to approach relative to each other in the direction parallel to the axis of the piping materials.

Figure 3:
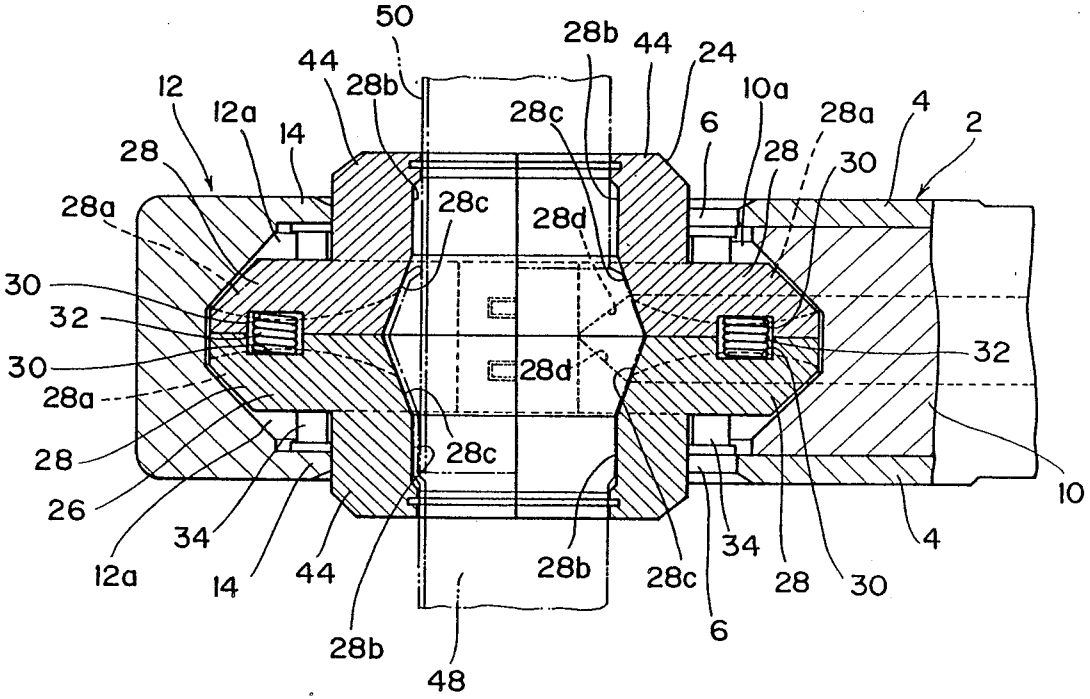
FIG. 3 also shows a plan view of the present joining device in cross-section, illustrating a state which the piping materials are joined.

Finally, as shown in FIG. 3, the compression springs 32 are completely pressed back in the retention holes 30 defined in the opposing surfaces of the half-die members 28. Thus, the tapered internal peripheral surfaces 28*c* of each half-die member 28 cause the joint where the pipe coupling 48 and the piping material 50 are overlapped with each other to be deformed plastically to provide a rigid junction therebetween.

Moreover, in the device according to this invention, there are disposed, for the first box-shaped cam housing 2, guide plates 36 each having a tapered end for guiding the motion of the half-die members 28 in combination with the guide surfaces 28*d* symmetrically disposed on the upper and lower ends of the half-die members 28 of the first processing die 24.

Accordingly, the two half-die members 28 approach relative to each other keeping their parallel relationship as guided by the guide plates 36, when the processing die 24 is pushed by the cam body 10. With this movement, the end faces of the half-die members 28 of the second processing die 26 are also pushed simultaneously to introduce the back faces of the half-die member 28 into the second box-shaped cam housing 12 to move them in the same manner as in the case of the first processing die 24 keeping their parallel relationship, at which end faces of the second processing die 26 being brought contact with the first processing die 24 through the pins 40. Consequently, the separated half-die members 28 achieve approaching motion integrally toward the joint of the piping materials keeping secured parallel relationship therebetween along the direction parallel to the axis of the piping materials, so that the joint of the piping material 50 and the pipe coupling 48 can be plastically deformed uniformly to provide rigid junction therebetween.

After completion of the joining operation, the pressing of the cam body 10 by the hydraulic cylinder 8 is released to cause the return spring 46 to reset the cam body 10. Then the clamping of the first and second box-shaped cam housings 2 and 12 are released to open them, and the two processing dies 24 and 26 are disengaged to remove the joined pipe coupling 48 and the piping material 50.

POSSIBILITY OF INDUSTRIAL EXPLOITATION

As apparent from the above description, according to this invention, the device for joining piping materials can be produced at low costs, since it has a simple structure and includes neither rotary system such as in the conventional press rolls nor complicated cam mechanism. Moreover, by virtue of the guide plates provided for the device, the half-die members for achieving plastic deformation of the joint of the piping materials can be kept in parallel to each other when they are moved closer to each other, thereby to provide uniform and rigid junction therebetween. Accordingly, the device of this invention, having overcome the above problems inherent in the prior art divices for joining piping materials, should be highly evaluated in practical uses.

We claim:

1. A device for joining piping materials, comprising:

a first processing die (24) in which a pair of half-die member (28) each having an inclined cam face (28*a*) formed on an outer side of its back portion are combined through connecting means, said half-die members (28) being mutually approachable in a direction parallel to the axis of the piping materials to be joined by use of a means for moving them closer or farther relative to each other;

a second processing die (26) having a similar structure to said first processing die (24) composed of a pair of half-die members (28) designed to be disposed symmetrically relative to the axis of said first processing die (24) and the piping materials;

a first and second box-shaped cam housings (2, 12) for receiving said two processing dies (24, 26), respectively, disposed to oppose each other, such that they can be opened or closed;

wherein said first and second box-shaped cam housings (2, 12) each having cam faces (10*a*, 12*a*) which push the respective inclined cam faces (28*a*) formed on said pair of half-die members (28) so as to move said pair of half-die members (28) closer to each other in said direction parallel to the axis of the piping materials to be joined; and guide plate (36) being disposed in at least one of said box-shaped cam housings (2, 12) to maintain movement of said half-die members (28) closer or farther relative to each other in said direction parallel to the axis of the piping materials to be joined, with opposing faces of the half-die members (28) being kept parallel to each other.

2. A device for joining piping materials according to claim 1, wherein said first box-shaped cam housing (2) has a cam body (10) to be interposed between said first box-shaped cam housing (2) and the half-die members (28), and having formed thereon inclined cam faces (10*a*) corresponding to the inclined cam faces (28*a*) formed on said pair of half-die members (28).

3. A device for joining piping materials according to claim 2, wherein said cam body (10) has a means for driving said first processing die (24).

4. A device for joining piping materials according to claim 1, wherein said first and second box-shaped cam housings (2, 12) have a means for clamping them together in a closed posture.

* * * * *